US011459165B2

(12) United States Patent
Judge

(10) Patent No.: US 11,459,165 B2
(45) Date of Patent: Oct. 4, 2022

(54) DEVICES AND METHODS FOR STORING AND TRANSPORTING SUBSTANCES

(71) Applicant: Purdue Research Foundation, West Lafayette, IN (US)

(72) Inventor: Jack W. Judge, Indianapolis, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 17/038,992

(22) Filed: Sep. 30, 2020

(65) Prior Publication Data

US 2021/0094751 A1 Apr. 1, 2021

Related U.S. Application Data

(60) Provisional application No. 62/908,324, filed on Sep. 30, 2019.

(51) Int. Cl.
*B65D 83/04* (2006.01)
*B65D 50/04* (2006.01)

(52) U.S. Cl.
CPC ..... *B65D 83/0463* (2013.01); *B65D 50/046* (2013.01); *B65D 2215/02* (2013.01); *B65D 2585/56* (2013.01)

(58) Field of Classification Search
CPC .. B65D 83/04; B65D 83/0463; B65D 50/046; B65D 2215/02; B65D 2585/56; B65B 7/00; B65B 69/0008
USPC ..... 206/1.5, 528, 530, 538–540, 815; 53/467, 492
See application file for complete search history.

(56) References Cited

U.S. PATENT DOCUMENTS 3,554,366 A * 1/1971 Corll ..... B65D 83/205 206/540
3,587,517 A * 6/1971 Fites et al. ..... B65D 83/0463 116/308
3,698,543 A * 10/1972 Trotta ..... B65D 55/02 206/540
4,053,090 A * 10/1977 Kelly ..... B65D 83/205 222/402.13

(Continued)

OTHER PUBLICATIONS

Sherrard, J. et al., "Barriers to Child Poisoning Prevention: Why Does Child Resistant Packaging Fail?", MONASH University, Accident Research Center; Funded by the Victorian Department of Human Services; Aug. 2005; (85 pages).

*Primary Examiner* — Luan K Bui
(74) *Attorney, Agent, or Firm* — Hartman Global IP Law; Gary M. Hartman; Domenica N. S. Hartman

(57) ABSTRACT

Devices and methods for storing and transporting substances. Such a device includes a base having a compartment for containing the substance, a lid closing the compartment and coupled to the base to selectively permit access to the compartment within the base, a cavity defined by the lid, the base, or at least in part a combination thereof, and an unlocking mechanism that immobilizes the lid relative to the base when the compartment is closed by the lid and releases the lid to enable the lid to pivot relative to the base to open the compartment. The unlocking mechanism is recessed within the cavity a distance from an opening of the cavity at an exterior of the device, and the unlocking mechanism is sufficiently recessed to be accessible with an adult's finger but not a child's finger.

20 Claims, 9 Drawing Sheets

(56) References Cited

U.S. PATENT DOCUMENTS

| | | | | | |
|---|---|---|---|---|---|
| 6,000,546 | A * | 12/1999 | Noble | ..... | A61J 1/03<br>206/1.5 |
| 7,494,012 | B1 * | 2/2009 | Priebe | ..... | A61J 1/03<br>206/1.5 |
| 7,798,330 | B2 * | 9/2010 | Noble | ..... | B65D 83/04<br>206/538 |

* cited by examiner

DEVICES AND METHODS FOR STORING AND TRANSPORTING SUBSTANCES

CROSS-REFERENCE TO RELATED APPLICATIONS

This application claims the benefit of U.S. Provisional Application No. 62/908,324, filed Sep. 30, 2019, the contents of which are incorporated herein by reference.

BACKGROUND OF THE INVENTION

The present application relates to methods and devices for storing and transporting substances. The application particularly relates to methods and devices suitable for storing and conveniently transporting a substance, including but not limited to a medication, whereby access to the substance is made difficult for young children, but is accessible to adults including those with dexterity issues such as arthritis.

There is an ever-present need for young children to be kept from accessing certain substances. As used herein, "substance" or "substances" refers to any matter which a user desires to render inaccessible to children and that can be stored in a container (herein also referred to as a "device") that can be transported by hand. Medications (including pills) are a nonlimiting example of such substances, as are other substances such as medical serums and cannabis. The term "substance" is therefore not to be understood as being limited to the application of pills, regardless of whether the term is actually used herein in the context of pills.

The problem of child poisoning from medication is unfortunately common, as young children learn about their environments by placing objects in their mouths, including doing so with medication that they find. Further, young children may not know the difference between medication and candy and may attempt to consume medication that they find or access, believing that it is edible.

While some medications consumed by children belong to a parent or sibling, a major concern is medication of grandparents and other adults whose dexterity may be limited, for example, as a result of arthritis. Much of this concern relates to problems with existing child-resistant devices. As used herein, the term "child-resistant," preceding words such as "closure," "mechanism," or "device" and not capitalized, does not exclusively refer to those devices which can be legally marketed as "Child-Resistant," as having met certain legal requirements (in the United States or anywhere else), but rather any device which has been designed with the intention of being unusable by children. Often, child-resistant mechanisms (such as those found on a standard prescription pill bottle) rely on hand strength and dexterity to be opened; that is, one must have a sufficient degree of strength and motor control to open the container. Because children have not developed a sufficient degree of dexterity, they are, in principle, unable to open the containers. This, however, also risks excluding the aging population, many members of which see a decline in their own dexterity (for instance, as the result of arthritis).

Because of this, it is not uncommon to see aging patients who are experiencing dexterity issues struggle to open child-resistant medicine containers. In some instances, upon finally opening such a container, a patient may lose control of the open device, spilling medication onto the ground or onto surfaces accessible by children. This medication can later be found by a young child and ingested. This is, of course, assuming that the device can be operated at all; in many cases, these dexterity-driven child-resistant devices are altogether too difficult for aging patients to use. There are, however, a handful of devices which do not rely on hand strength to be opened. In general, these exceptions rely on either cognition (i.e., children lack the reasoning capacity to understand how to open the device) or special access (e.g., the owner possesses a code or key of some sort, which the child does not). Neither of these alternative methods should be relied upon in the case of an aging population: the former, because a pill container should not be complicated to open in the event of a medical emergency; the latter because there is a risk of losing one's means of access, which can also be disastrous in an emergency situation. Many aging patients thus elect to use non-child-resistant containers for the storage and carrying of medication. These devices, of course, pose a serious hazard around young children, as they can be easily opened.

Thus, there exists a need for methods and devices, specifically for holding substances such as medication, which permit access by members of the aging population, but are very challenging for children to operate and access.

BRIEF SUMMARY OF THE DISCLOSURE

The present disclosure describes devices and methods for storing and conveniently transporting substances, wherein the devices render a substance inaccessible by young children, yet more accessible to adult users with dexterity issues than conventional child-resistant devices.

According to one aspect of the invention, such a device includes a base having a compartment for containing the substance, a lid closing the compartment and coupled to the base so as to selectively open and close the compartment of the base to selectively permit access to the compartment within the base, at least one cavity defined by the lid, the base, or at least in part a combination thereof, and an unlocking mechanism that immobilizes the lid relative to the base when the compartment of the base is closed by the lid and releases the lid to enable the lid to pivot relative to the base to open the compartment of the base. The unlocking mechanism is recessed within the cavity a recessed distance from an opening of the cavity at an exterior of the device, and the unlocking mechanism is sufficiently recessed so as to be accessible with a finger of an adult but inaccessible by a finger of a child.

According to another aspect of the invention, a method for storing and transporting substances includes placing the substance in a compartment of a base, closing the compartment of the base with a lid so as to prevent access to the compartment, and opening the compartment by operating an unlocking mechanism that immobilizes the lid relative to the base when the compartment of the base is closed by the lid. The unlocking mechanism is recessed within a cavity and is a sufficient recessed distance from an opening of the cavity to be accessible with a finger of an adult but inaccessible by a finger of a child.

A technical aspect of the invention is that, rather than utilizing devices and methods that rely on hand strength/dexterity, cognition, special access, or another existing method, devices and methods described here rely on finger length; that is, a child's fingers are too short to unlock and open the device. This is accomplished via a finger-operated unlocking mechanism, for example, one or more buttons, that is recessed deep in a cavity (which may be a hole, recess, etc.) in the device, wherein the cavity is wide enough for most adult fingers to fit into but deeper/longer than the length of at least the average length of children's fingers. To open the container, an intended user inserts his or her finger into the cavity and operates the unlocking mechanism to unlock the container and open the device to gain access to an interior compartment within the device that contains a substance. Because the unlocking mechanism is recessed in the cavity, and thus shielded from external forces, it is unlikely to be accidentally pressed by any foreign object and unlocked. The unlocking mechanism can therefore be designed to require only minimal pressure in its operation in order to maximize usability for those adult users with dexterity issues.

Other aspects and advantages of this invention will be appreciated from the following detailed description

DETAILED DESCRIPTION OF THE INVENTION

Figure 1:
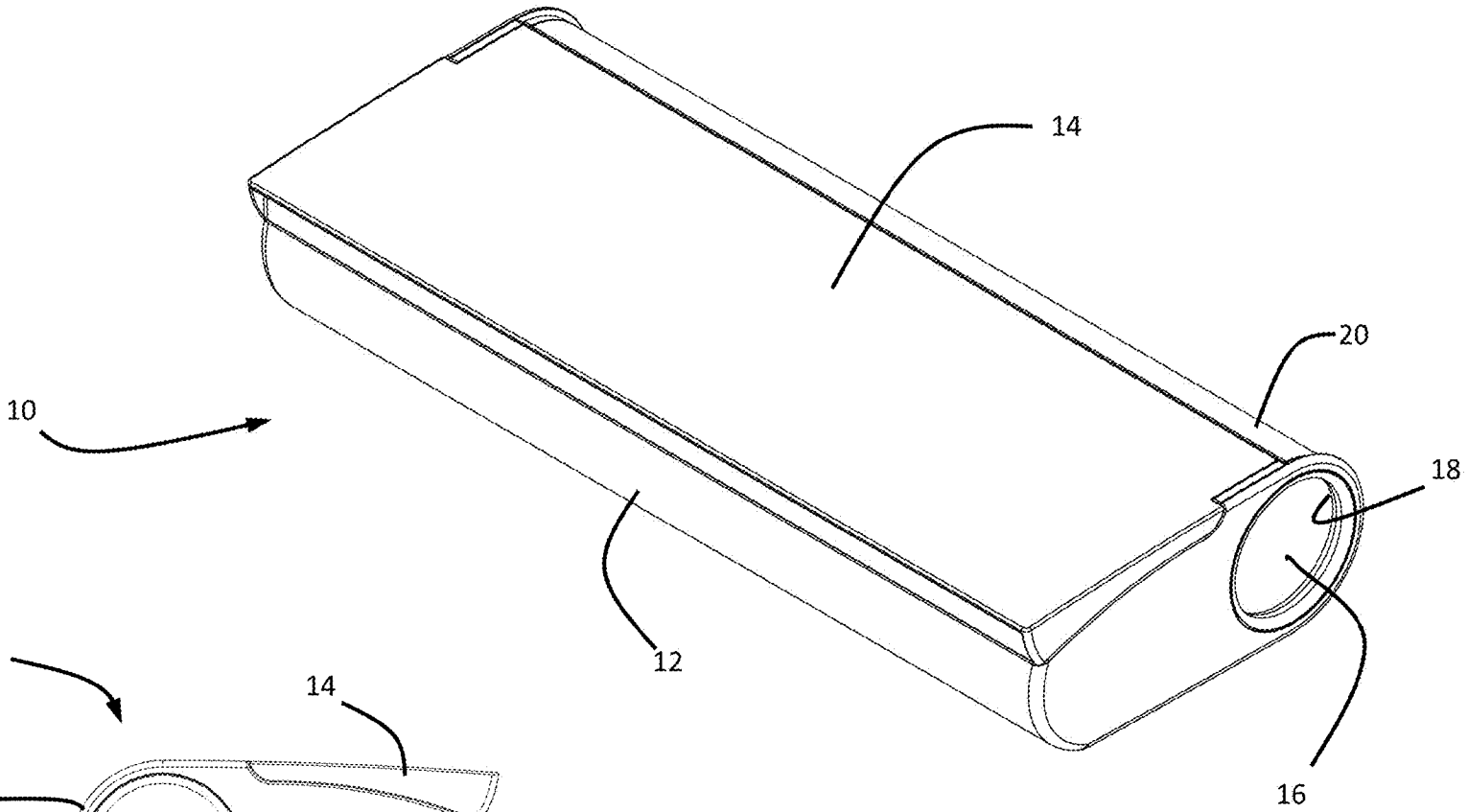
FIGS. 1 and 2 depict perspective and end views, respectively, of a first nonlimiting embodiment of a device in a closed and locked state.

The terminology used herein is for the purpose of describing only particular embodiments of the invention and is not intended to be limiting to the invention. Unless otherwise defined, all terms herein will have meaning commonly understood by one of ordinary skill in the art to which this invention belongs. It will also be understood that terms, such as those found in standard dictionaries, should have definitions consistent with their meanings in the context of the relevant art, and will not be interpreted in an overly formal or idealized manner, unless noted otherwise.

Devices for containing substances and methods for their use are discussed herein. In the ensuing description, numerous details are provided in order to ensure a thorough understanding of the invention. It will be evident, however, to one skilled in the art that the present invention may be practiced without these specific details. As such, the present disclosure is to be considered an exemplification of the invention, not intended to limit the invention to the specific embodiments depicted and described below. Attributes of the specific appearance (including, but not limited to material, finish, size, and shape), unless otherwise noted, are not limiting to the invention, nor critical to the function and operation of the device unless stated otherwise.

The present invention will now be described by referencing the appended drawings representing particular but nonlimiting embodiments of devices 10, 50, 60, and 70. As shown the drawings, the devices 10, 50, 60, and 70 are described as containers suitable for containing pills, though this description is not limiting to the invention, as the devices 10, 50, 60, and 70 can be used to contain a wide variety of substances. To facilitate the description provided below of the devices 10, 50, 60, and 70 represented in the drawings, relative terms, including but not limited to, "vertical," "horizontal," "lateral," "front," "rear," "side," "forward," "rearward," "upper," "lower," "above," "below," "right," "left," etc., may be used in reference to an orientation of the devices 10, 50, 60, and 70 as represented in the drawings. All such relative terms are intended to indicate the construction and relative orientations of components and features of the devices 10, 50, 60, and 70, and therefore are relative terms that are useful to describe the illustrated embodiments but should not be otherwise interpreted as limiting the scope of the invention.

Figure 2:
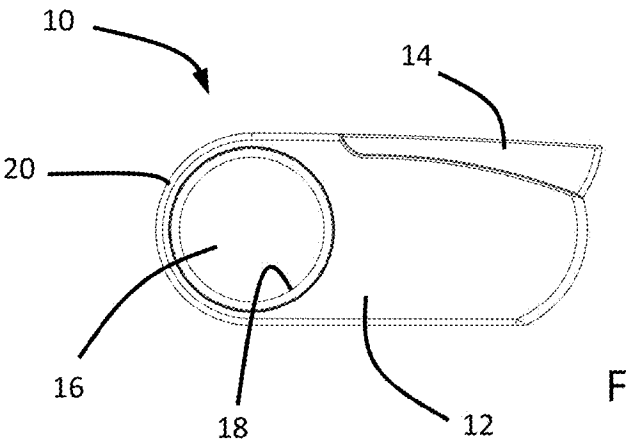
Figure 3:
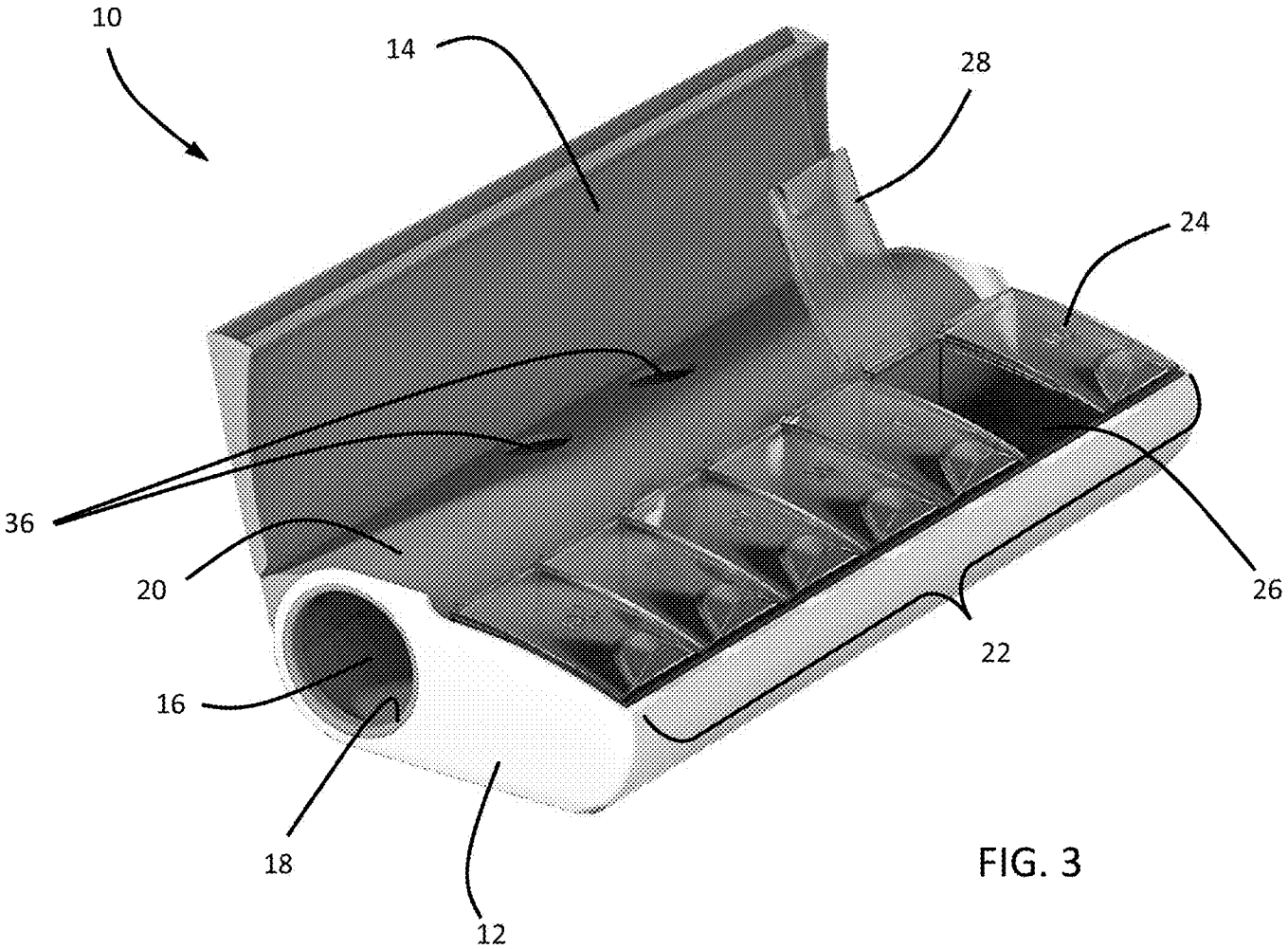
FIG. 3 depicts a perspective view of the device of FIG. 1 in an open and unlocked state, with an internal division within the device shown as being open.

FIGS. 1 and 2 depict the device 10 as it may appear when in a closed and locked state, and FIG. 3 depicts the device as it may appear when in an open and unlocked state. As depicted, the device 10 has an outer three-dimensional shape general corresponding to a parallelepiped so as to have a length that is greater than its height and width, though such a shape is nonlimiting and other shapes are foreseeable. The device 10 further has a base 12 to which a lid 14 is coupled, for example, pivotally attached along a rear side of the device 10. The device 10 preferably has a size and weight that permits a person to transport the device 10 by hand, i.e., a handheld device. A hole, recess, passageway, or cavity (hereinafter, cavity) 16 is defined at the rear of the device 10 and an unlocking mechanism (FIG. 4) is concealed within the cavity 16. The cavity 16 is oriented longitudinally (lengthwise) within the body of the device 10 along the rear side of the device 10. In the embodiment of FIGS. 1 through 5D, the cavity 16 is defined by a tubular portion 20 that is integrally formed with the lid 14 and is rotatably coupled to the base 12 to define a hinge by which the lid 14 pivots relative to the base 12. The cavity 16 defines two openings 18, for example, at opposite ends of the tubular portion 20 as shown, such that the openings 18 are located at the exterior of the device 10, for example, at oppositely-disposed longitudinal ends of the device 10 as shown. In the embodiment of the device 10 shown in FIGS. 1 through 5D, the cavity 16 is entirely defined by and within the tubular portion 20 of the lid 14, though it is foreseeable that the cavity 16 could by entirely defined by and within the base 12, or a combination of the lid 14 and base 12.

As depicted in FIG. 3, a weekly pill organizer 22 is depicted within an interior 13 defined by the base 12 of the device 10, with seven individual divisions 24, one for each day of the week. Each division 24 defines a compartment 26 closable by a cap 28. Each compartment 26 is preferably sized to accommodate and store one or more pills or other substances. The division 24 second from the right end of the device 10 in FIG. 3 is shown with its cap 28 open and its compartment 26 exposed. The caps 28 can be configured to remain closed via standard snap fittings, as are found on many existing pill containers and other container-type devices, and therefore are common knowledge to one skilled in the art relevant to the present invention. Though the specific size, shape, and other qualities of the snap fittings are not relevant to the function of the device 10 itself, they will ideally be designed to be easy to open, subjectively, for adult users with dexterity issues. As the device 10 will generally only be open while being handled by an adult, it is unlikely that children will access and open the divisions 24 at any point. Other embodiments may contain a different number of divisions 24 and may arrange them in a different manner, or may forego the use individual divisions 24 altogether, opting for one large compartment 26 within the base 12, with or without a cap 28.

Figure 4:
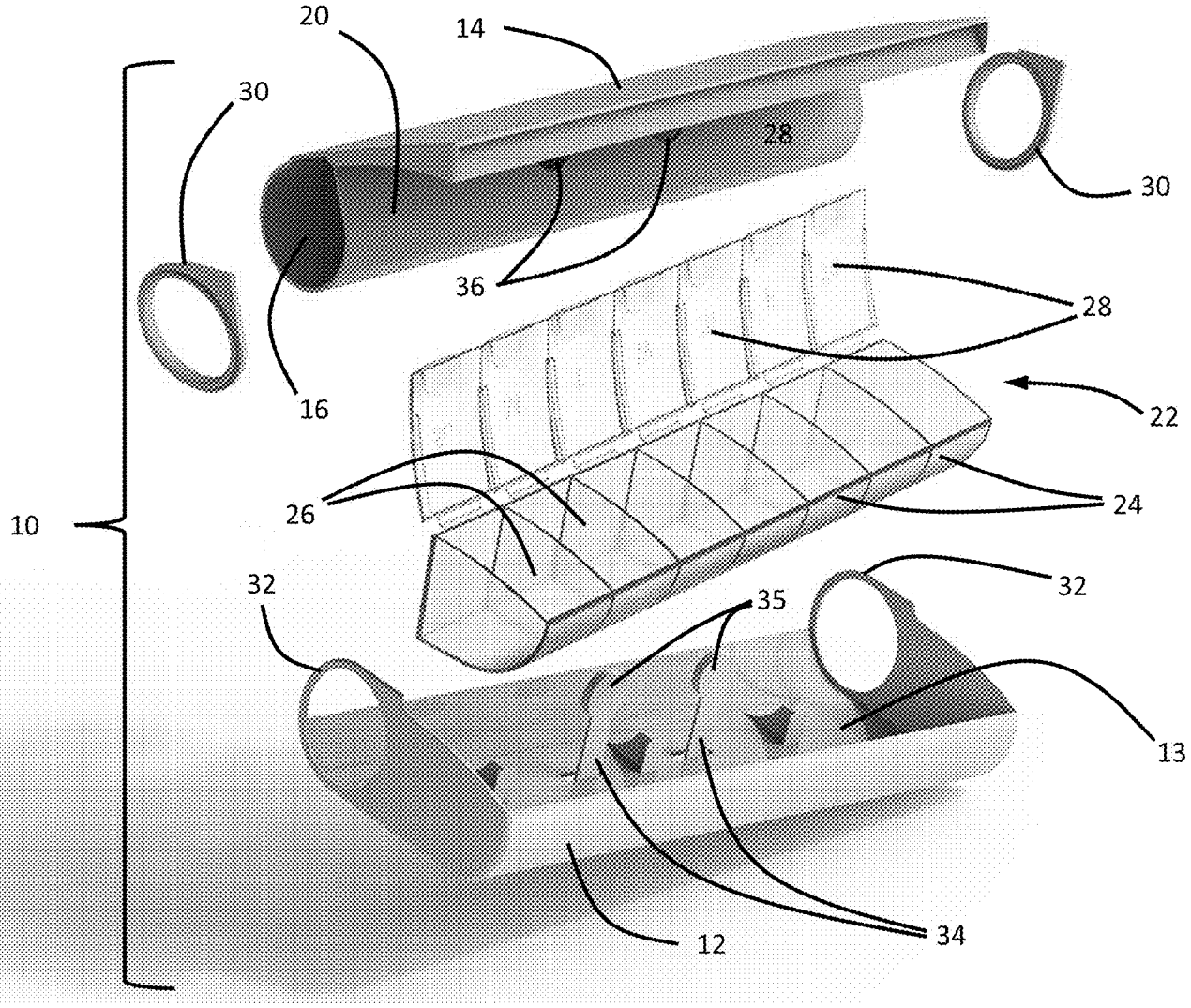
FIG. 4 depicts a perspective exploded view of the device of FIG. 1.

FIG. 4 depicts the device 10 with its various components separated from one another in order to provide a clearer view of the various components. Visible here are the base 12, the lid 14, the tubular portion 20 in which the cavity 16 is formed, the organizer 22, hinge couplings 30 that rotatably attach the tubular portion 20 to complementary annular portions 32 of the base 12, and the unlocking mechanism. As a nonlimiting embodiment, the unlocking mechanism is shown in FIG. 4 as comprising two actuating members in the form of arms 34 that are each cantilevered from the base 12 to extend from the base 12 and toward the lid 14 in a direction generally transverse to the longitudinal axis of the cavity 16. The arms 34 terminate with buttons 35 and the unlocking mechanism further comprises complementary latching holes 36 that are formed in the tubular portion 20 surrounding the cavity 16. The holes 36 are engageable by the buttons 35 from the exterior of the tubular portion 20 to prevent the tubular portion 20 from pivoting relative to the base 12 and thereby immobilize the lid 14 relative to the base 12 while the lid 14 is in its closed position (FIGS. 1 and 2). As such, the unlocking mechanism may also be characterized as a locking mechanism. Each arm 34 biases its button 35 into engagement with its corresponding latching hole 36 such that the buttons 35 at least partially protrude through the latching holes 36 and are accessible from within the cavity 16 as a result of being at least partially exposed through the latching holes 36. By engaging the latching holes 36, the buttons 35 prevent the tubular portion 20 from rotating relative to the base 12, which immobilizes the lid 14 relative to the base 12.

The arms 34 can be deflected by pressing the exposed buttons 35 recessed within the cavity 16 to disengage them from their respective latching holes 36, thereby releasing the tubular portion 20 to enable the lid 14 to pivot relative to the base 12 and permit access to the compartments 24 within the base 12 (FIG. 3). When any button 35 is engaged (latched) with its latching hole 36, the lid 14 is immobilized in its closed position relative to the base 12, such that the unlocking mechanism may also be characterized as a locking mechanism. The lid 14 remains immobilized unless all buttons 35 have been pressed to cause their arm 34 to sufficiently deflect (pivot) to disengage their buttons 35 from the complementary latching holes 36. While both buttons 35 are depicted as protruding into the same cavity 16, it is foreseeable that the device 10 could comprise multiple cavities 16, each with one or more unlocking mechanisms. Other embodiments may add, combine, or omit one or more of the components depicted in FIG. 4. For example, the purpose of the hinge couplings 30 is to pivotally connect the lid 14 to the base 12 and allow the lid 14 to rotate freely between its open and closed positions. The hinge couplings 30 are shaped as rings, such that a user must insert their fingers through the hinge couplings 30 in order to access the buttons 35 within the cavity 16 for the purpose of opening the device 10. Other embodiments may manufacture the function of the hinge couplings 30 directly onto the lid 14 and/or base 12, and/or may accomplish the function of the hinge couplings 30 in a manner which does not require the user to insert their fingers through the hinge couplings 30, if such a solution is found to be desirable. These are only a few examples and are in no way limiting to the invention and its possible embodiments.

Figure 11A:
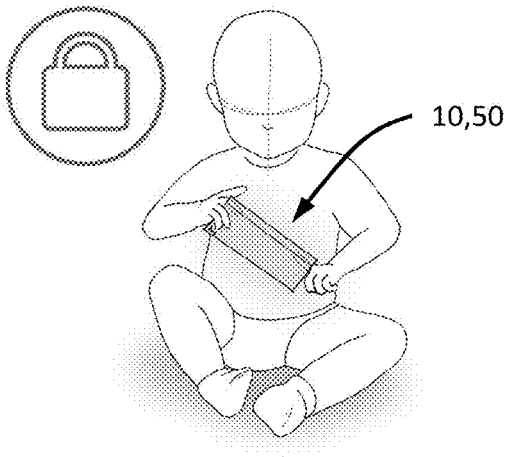
FIGS. 11A and 11B illustrate a safety benefit of the devices of FIGS. 1 through 10.
Figure 11B:
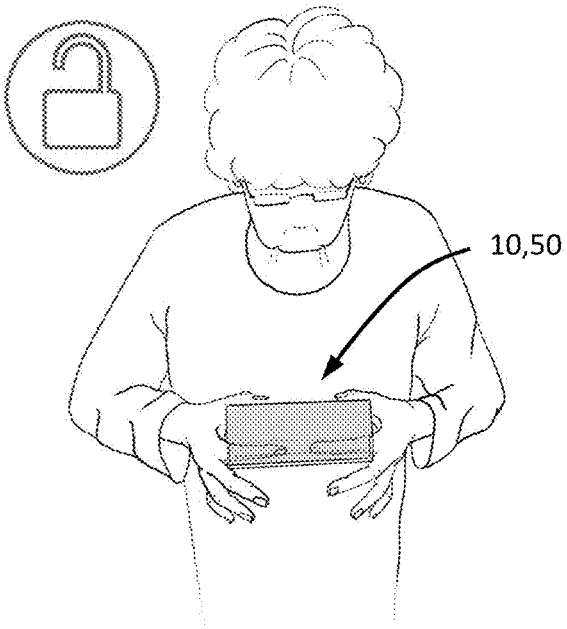

FIGS. 5A through 5D demonstrate nonlimiting steps for using the device 10 represented in FIGS. 1 through 4. In order to access a substance contained within the device 10 (e.g., within one of its divisions 24 that is inaccessible because the base 12 is closed by the lid 14), an adult user inserts two fingers (represented as index fingers), each through one of the opposite openings 18 of the cavity 16 (FIG. 5A), to access the buttons 35 recessed deep within the cavity 16. The buttons 35 are placed at a sufficient recessed distance from the openings 18 of the cavity 16 so that each can be accessed by most adults (FIG. 11B), but most children (particularly below age five) cannot (FIG. 11A). As a nonlimiting example, the buttons 35 may be recessed greater than about 50 mm, for example, about 56 to 58 mm (optionally more) from their respective openings 18. The rationale for these dimensions is that index fingers of small adult hands (e.g., $5^{th}$ percentile of adult women) have been reported to be about 60 mm in length, middle fingers of large child hands (e.g., $97.5^{th}$ percentile of children aged 48 to 54 months) have been reported to be about 55 mm in length, and the most at-risk children among all age groups (through age 19 years) have been reported to be ages 12 to 24 months, whose middle fingers are significantly shorter than 55 mm, for example, less than 50 mm.

Figure 5A:
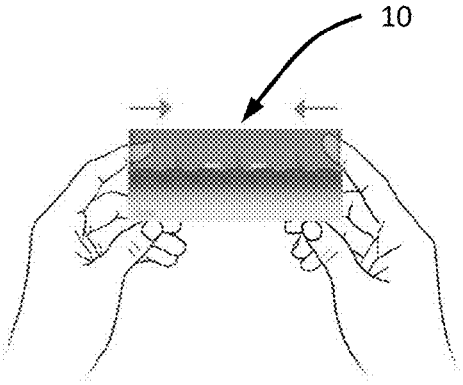
FIGS. 5A through 5D illustrate a pattern of using the device of FIG. 1.
Figure 5B:
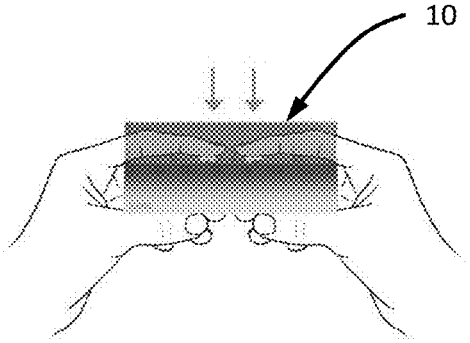
Figure 5C:
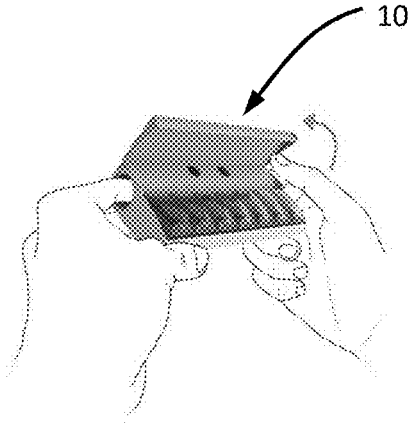
Figure 5D:
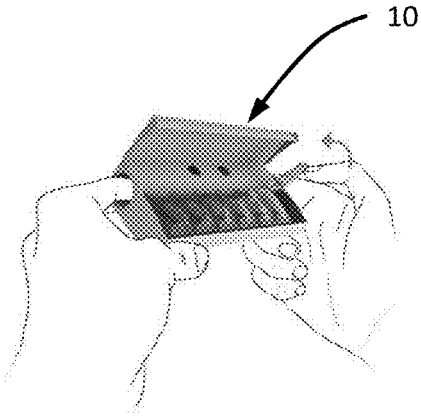

Once the user has accessed the buttons 35, they are simultaneously pressed or otherwise deflected (FIG. 5B) to unlock the device 10 by disengaging the buttons 35 of the device 10 from their respective latch holes 36 that anchor and immobilize the lid 14 relative to the base 12. Only when both buttons 35 are simultaneously pushed out of their respective latch holes 36 is the lid 14 able to rotate freely (FIG. 5C). The user can then access the contained substances (FIG. 5D).

FIGS. 6 through 10 and 12 through 15 depict the devices 50, 60, and 70 representative of the further nonlimiting embodiment of this invention. For convenience, identical reference numerals are used in FIGS. 6 through 10 and 12 through 15 to denote the same or functionally related/equivalent elements described for the device 10 of FIGS. 1 through 5B. In view of similarities between the devices 10, 50, 60, and 70, the following discussion of FIGS. 6 through 10 and 12 through 15 will focus primarily on aspects of the device 50 that differ from the device 10 in some notable or significant manner. Other aspects of the device 50 not discussed in any detail can be, in terms of structure, function, materials, etc., essentially as was described for the device 10.

Figure 6:
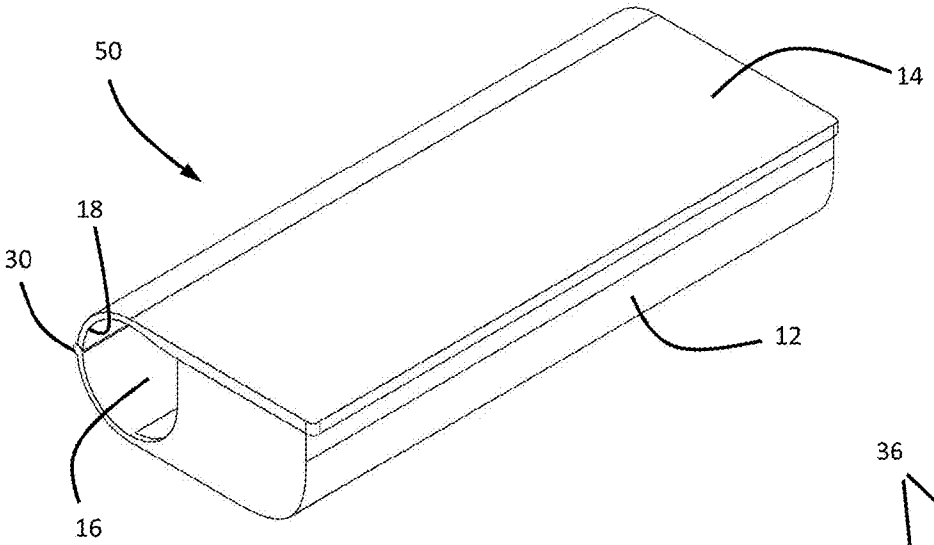
FIGS. 6 and 7 depict perspective views of a second nonlimiting embodiment of a device in, respectively, a closed and locked state and an open and unlocked state.
Figure 7:
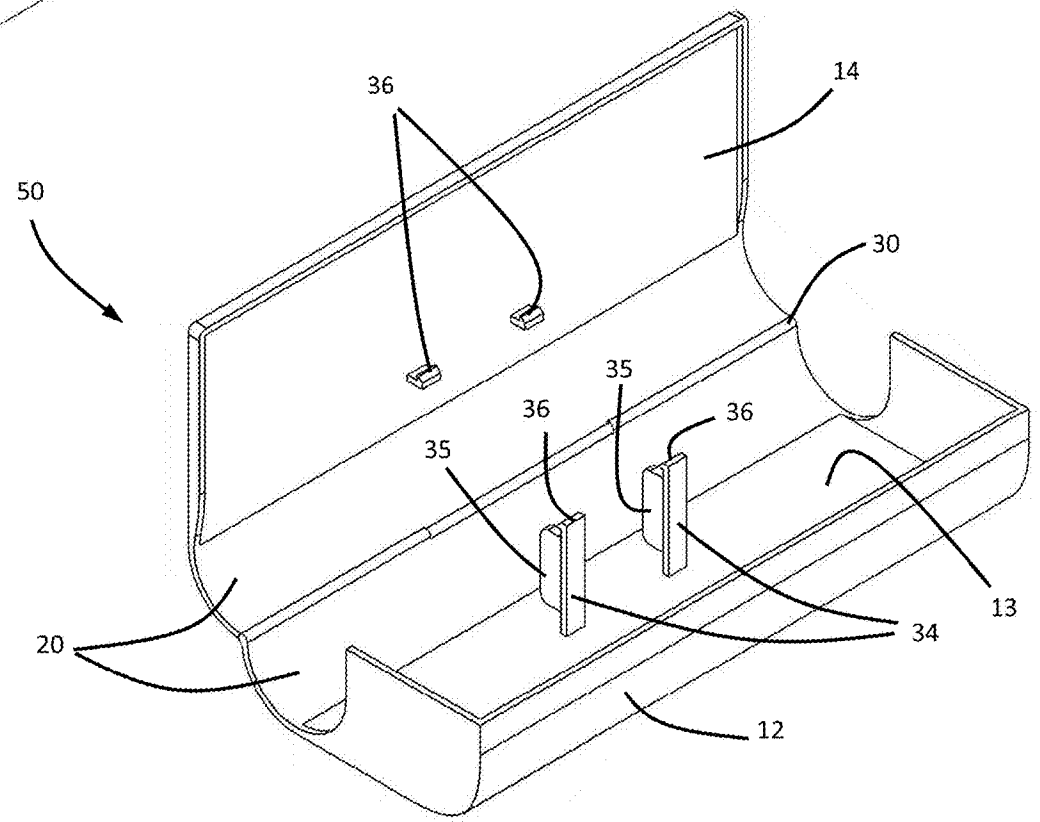
Figure 8:
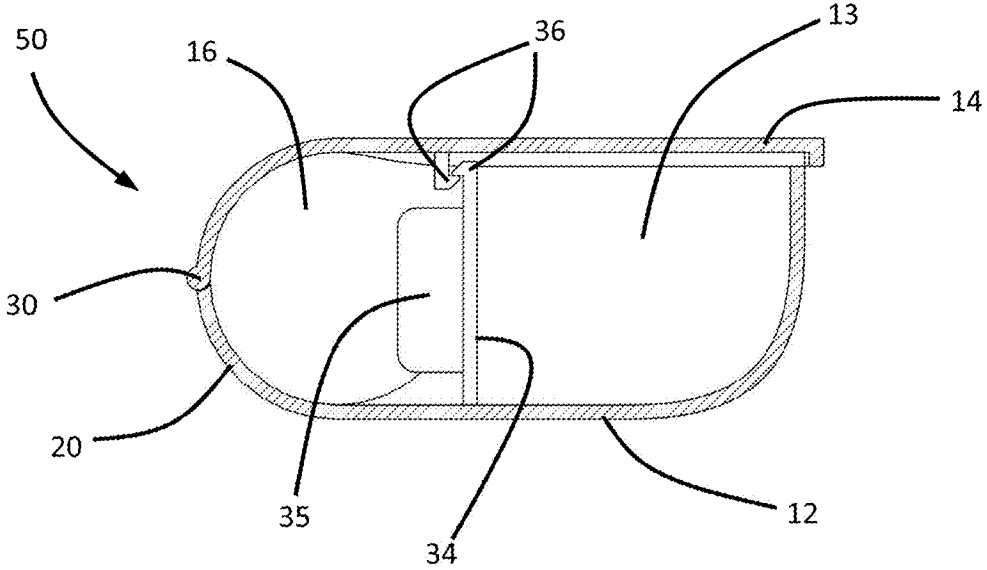
FIGS. 8, 9, and 10 are end views of the device of FIGS. 6 and 7 showing a progression of steps from the closed and locked state of FIG. 6 to the open and unlocked state of FIG. 7.
Figure 9:
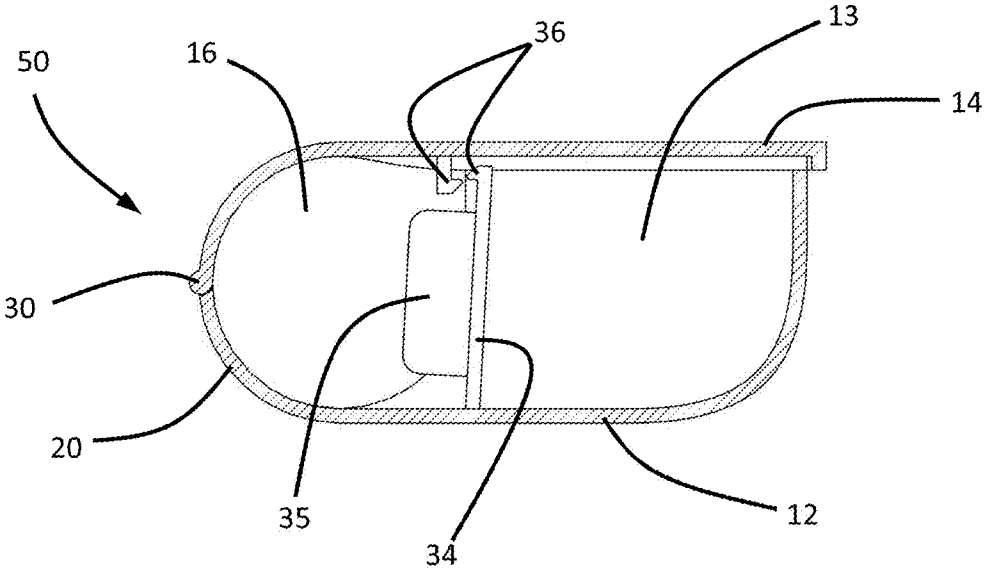

FIG. 6 depicts the device 50 as it may appear when in a closed and locked state, and FIG. 7 depicts the device as it may appear when in an open and unlocked state. The device 50 has a base 12 to which a lid 14 is coupled, which in FIGS. 6 through 10 is with a hinge 30 that is integrally formed with the base 12 and lid 14 along a rear side of the device 10. A cavity 16 is defined at the rear of the device 10 and an unlocking mechanism (FIG. 2) is concealed within the cavity 16. In the embodiment of FIGS. 6 through 10, the cavity 16 is defined by two halves of a tubular portion 20 to create a clam shell design in which each half of the tubular portion 20 is integrally formed with either the base 12 or the lid 14 and the halves are pivotably coupled by the hinge 30 so that pivoting the lid 14 relative to the base 12 between the open and closed states simultaneously causes the halves of the tubular portion 20 to pivot relative to each other between an open state (FIG. 7) and a closed state (FIG. 6) in which the halves define the tubular portion 20. The cavity 16 is entirely defined by and within the tubular portion 20, which also defines two openings 18 at opposite ends of the cavity 16 such that the openings 18 are located at oppositely-disposed longitudinal ends of the device 10. An organizer, such as that described above for the device 10, is not depicted in FIGS. 6 through 10, but as before an organizer of any desired configuration can be incorporated into the base 12 (or lid 14) of the device 50.

Figure 10:
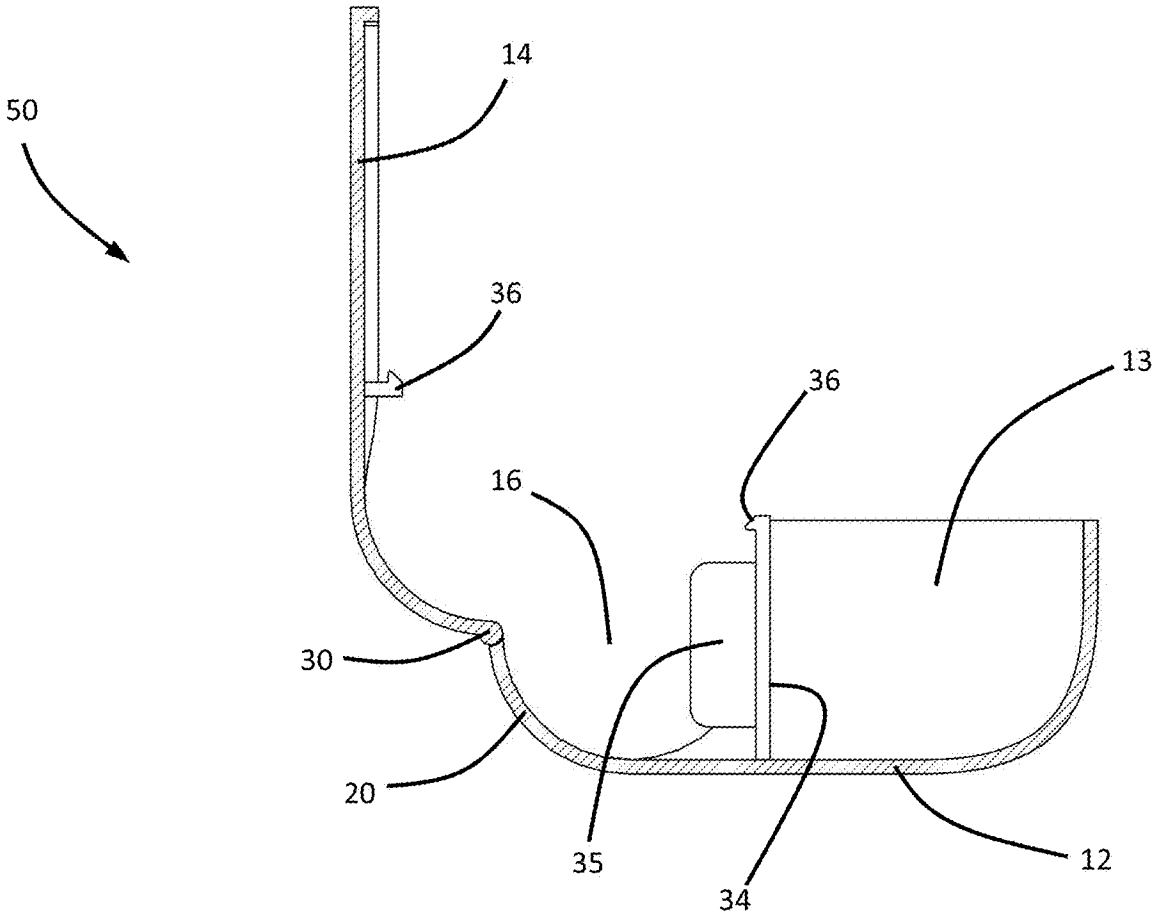

FIG. 7 represents the unlocking mechanism as comprising two actuating members in the form of arms 34 that are cantilevered from the base 12. As represented in FIGS. 7 through 10, the arms 34 extend from the base 12 and toward the lid 14 between the cavity 16 and an interior 13 defined by the base 12. Buttons 35 protrude from the arms 34 so as to transversely protrude into the cavity 16. The unlocking mechanism further comprises sets of complementary latches 36. Each set of latches 36 comprises a first latch 36 located on an arm 34 and a second latch 36 located on an interior surface of the lid 14 so as to be engageable and disengageable with its complementary latch 36 located on an arm 34. Each arm 34 biases its latch 36 into engagement with the complementary latch 36 located on the lid 14 (FIG. 8) to immobilize the lid 14 relative to the base 12, and can be deflected to disengage its latch 36 from the complementary latch 36 of the lid 14 to release the lid 14 (FIG. 9) and enable the lid 14 to pivot relative to the base 12 and permit access to the interior 13 of the base 12 (FIGS. 7 and 10). When either set of latches 36 is engaged (latched) with each other, the lid 14 is immobilized in its closed position relative to the base 12 (FIG. 8), such that the unlocking mechanism may also be characterized as a locking mechanism. The lid 14 remains immobilized unless all buttons 35 have been pressed to cause their arm 34 to sufficiently deflect (pivot) to disengage their latches 36 from the complementary latches 36 attached to the lid 14. As evident from FIGS. 11A and 11B, the operational and safety benefits of the device 10 of FIGS. 1 through 5B are applicable to the device 50 of FIGS. 6 through 10.

Figure 12:
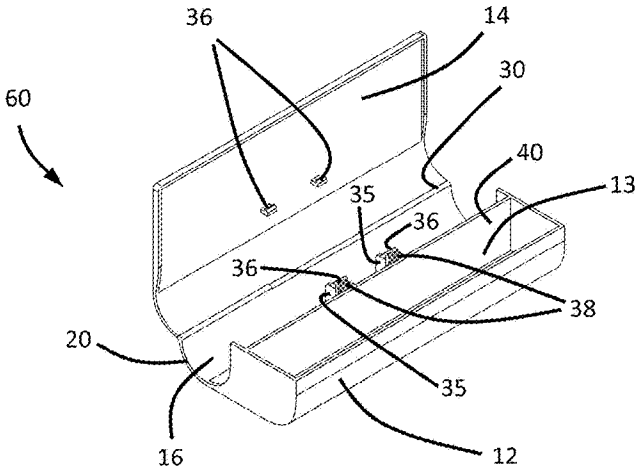
FIGS. 12, 13, and 14 depict different views of a third nonlimiting embodiment of a device.
Figure 13:
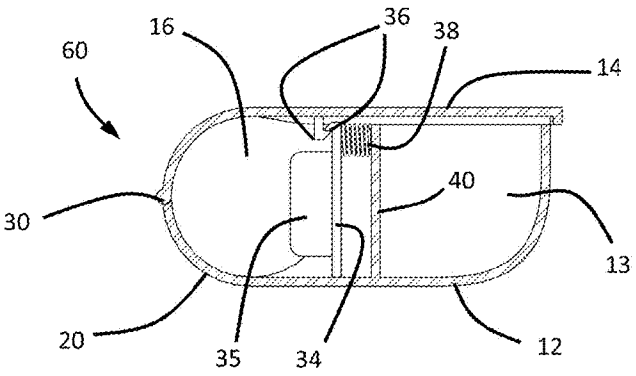
Figure 14:
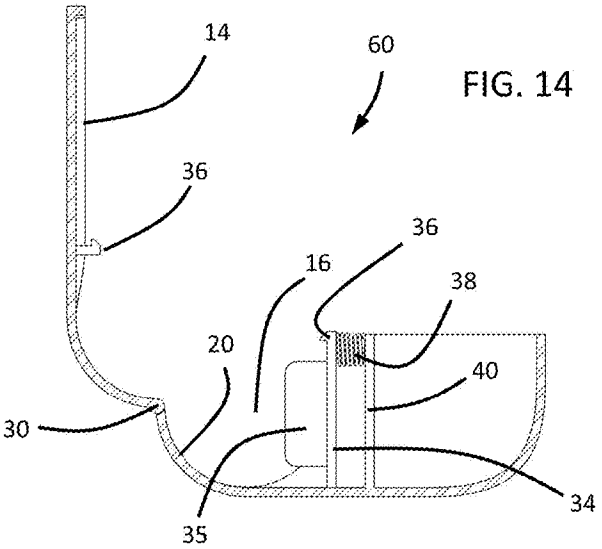

The device 60 of FIGS. 12, 13, and 14 represent a modification of the embodiment of FIGS. 6 through 10 as the result of the inclusion of springs 38 that bear against an interior wall 40 of the base 12 to apply additional biasing forces to the arms 34. This configuration can be utilized to reduce the biasing force required of the arms 34 to latch the latches 36 and/or to promote firmer latching of the latches 36, for example, yielding a container that can be used by individuals who do not have dexterity issues.

Figure 15:
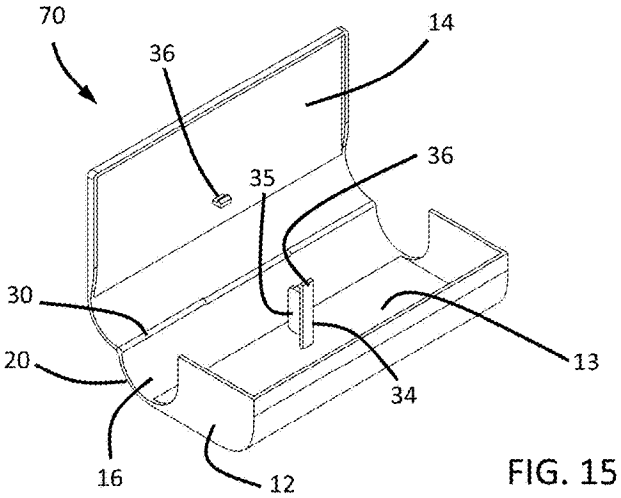
FIG. 15 depicts a perspective view of a fourth nonlimiting embodiment of a device.

The device 70 of FIG. 15 is representative of an embodiment that employs only one cantilevered arm 34 and button 35, but is otherwise similar to the embodiment of FIGS. 6 through 10.

Additional embodiments of the invention may utilize a different type of unlocking mechanism. Other embodiments may not utilize a button-latch configuration at all. For example, a similar locking effect could be attained by placing a catch along the front edge of the lid 14 which, when closed, locks the lid 14 into the base 12, immobilizing the lid 14. There may then be buttons placed at a similar position inside the cavity 16 as the device 10, which are connected to the catch at the front of the device 2 and, when pressed, release the catch, allowing the lid 14 to rotate freely. Further embodiments may utilize an unlocking mechanism that utilizes different forms of actuating members. As non-limiting examples, rather than requiring the user to press buttons, a user may operate one or more actuating members in the form of a slide mechanism—that is, a small component that resides on a track, along which it can slide, and only when said component has been pushed to one side of the track will the lid 14 be able to rotate freely. Like the previous examples, the slide mechanism may have similar positioning within the cavity 16 to the unlock mechanism of the devices 10 and 10 shown in FIGS. 1 through 11B, such that it is unreachable by children. The embodiments listed here are not an exhaustive list, and are not limiting to the present invention; rather, they are examples of ways in which an unlocking mechanism can be implemented with a container for storing substances, which is only operable by those who have fingers of sufficient length (i.e., adults, and not children).

In view of the above, while the invention has been described in terms of particular embodiments, it should be apparent that alternatives could be adopted by one skilled in the art. For example, the devices 10, 50, 60, and 70 and their components could differ in appearance and construction from the embodiments described herein and shown in the drawings, functions of certain components of the devices 10, 50, 60, and 70 could be performed by components of different construction but capable of a similar (though not necessarily equivalent) function, and various materials could be used in the fabrication of the devices 10, 50, 60, and 70 and/or their components. As such, it should be understood that the intent of the above detailed description is to describe the particular embodiments represented in the drawings and certain but not necessarily all features and aspects thereof, and to identify certain but not necessarily all alternatives to the particular embodiments represented in the drawings. As a nonlimiting example, the invention encompasses additional or alternative embodiments in which one or more features or aspects of a particular embodiment could be eliminated or two or more features or aspects of different described embodiments could be combined. Accordingly, it should be understood that the invention is not necessarily limited to any particular embodiment represented in the drawings or described herein, and that the purpose of the above detailed description and the phraseology and terminology employed therein is to describe the particular embodiments represented in the drawings, and not necessarily to serve as limitations to the scope of the invention. Therefore, the scope of the invention is to be limited only by the following claims.

The invention claimed is:

1. A device for storing and transporting a substance, the device comprising:

a base having a compartment for containing the substance;

a lid closing the compartment of the base, the lid being coupled to the base so as to selectively open and close the compartment of the base to selectively permit access to the compartment within the base;

at least one cavity defined by the lid, the base, or at least in part a combination thereof, the cavity defining at least a first opening and a second opening at an exterior of the device; and an unlocking mechanism that immobilizes the lid relative to the base when the compartment of the base is closed by the lid and releases the lid to enable the lid to pivot relative to the base to open the compartment of the base, the unlocking mechanism being recessed within the cavity a recessed distance from the first opening of the cavity and recessed within the cavity a second recessed distance from the second opening of the cavity so as to be accessible through each of the first and second openings with a finger of an adult but inaccessible by a finger of a child.

2. The device of claim 1, wherein the unlocking mechanism comprises at least one actuating member.

3. The device of claim 2, wherein the at least one actuating member comprises at least one arm and a button attached thereto, and the button protrudes into the cavity and is located within the cavity at the recessed distance from the first opening of the cavity.

4. The device of claim 3, wherein the at least one arm is cantilevered from the base, the unlocking mechanism further comprises a latching hole, the at least one arm biases the button into engagement with the latching hole to immobilize the lid relative to the base, and the at least one arm is capable of being deflected to disengage the button from the latching hole to enable the lid to pivot relative to the base.

5. The device of claim 1, wherein the cavity is defined by a tubular portion integrally formed with the lid and pivotably coupled to the base.

6. The device of claim 1, wherein the cavity is defined by a tubular portion comprising first and second halves connected to each other by a hinge, the first half is integrally formed with the lid, and the second half is integrally formed with the base.

7. The device of claim 1, wherein the unlocking mechanism comprises at least first and second actuating members that are individually accessible from, respectively, the first and second openings of the cavity.

8. The device of claim 1, wherein the recessed distance from the first opening of the cavity is greater than 50 mm.

9. The device of claim 1, wherein the recessed distance from the first opening of the cavity is 56 to 58 mm.

10. A method of storing and transporting a substance in the device of claim 1, the method comprising:

placing the substance in the compartment of the base;

closing the compartment of the base with the lid to prevent access to the compartment; and opening the compartment by operating the unlocking mechanism through either or both of the first and second openings with a finger of an adult.

11. The method of claim 10, wherein the unlocking mechanism biases a button into engagement with a latching hole associated with the lid to immobilize the lid relative to the base, and opening the compartment comprises accessing the unlocking mechanism within the cavity to disengage the button from the latching hole to enable the lid to pivot relative to the base.

12. The method of claim 10, wherein the unlocking mechanism biases a first latch into engagement with a second latch associated with the lid to immobilize the lid relative to the base, and opening the compartment comprises accessing the unlocking mechanism within the cavity to disengage the first latch from the second latch to enable the lid to pivot relative to the base.

13. The method of claim 10, wherein the cavity is defined by a tubular portion integrally formed with the lid and pivotably coupled to the base, and opening the compartment of the base comprises pivoting the tubular portion relative to the base.

14. The method of claim 10, wherein the cavity is defined by a tubular portion comprising first and second halves connected to each other by a hinge, the first half is integrally formed with the lid and the second half is integrally formed with the base, and opening the compartment of the base comprises pivoting the first and second halves of the tubular portion relative to each other.

15. The method of claim 10, wherein the unlocking mechanism comprises at least first and second actuating members that are individually accessible from, respectively, the first and second openings of the cavity, and opening the compartment comprises simultaneously accessing the first and second actuating members within the cavity through, respectively, the first and second openings to enable the lid to pivot relative to the base.

16. The method of claim 10, wherein the recessed distance from the first opening of the cavity is greater than 50 mm.

17. The method of claim 10, wherein the recessed distance from the first opening of the cavity is 56 to 58 mm.

18. The method of claim 10, wherein the substance is a medication.

19. A device for storing and transporting a substance, the device comprising:

a base having a compartment for containing the substance;

a lid closing the compartment of the base, the lid being coupled to the base so as to selectively open and close the compartment of the base to selectively permit access to the compartment within the base;

at least one cavity defined by the lid, the base, or at least in part a combination thereof, the cavity defining at least a first opening at an exterior of the device; and an unlocking mechanism that immobilizes the lid relative to the base when the compartment of the base is closed by the lid and releases the lid to enable the lid to pivot relative to the base to open the compartment of the base, the unlocking mechanism being recessed within the cavity a recessed distance from the first opening of the cavity that is sufficient so as to be accessible through the first opening with a finger of an adult but inaccessible by a finger of a child;

wherein the unlocking mechanism comprises at least one actuating member;

wherein the at least one actuating member comprises at least one arm and a button attached thereto, and the button protrudes into the cavity and is located within the cavity at the recessed distance from the first opening of the cavity; and wherein the at least one arm is cantilevered from the base, and the unlocking mechanism further comprises complementary first and second latches on the at least one arm and on the lid, the at least one arm biases the first latch into engagement with the second latch to immobilize the lid relative to the base, and the at least one arm is capable of being deflected to disengage the first latch from the second latch to enable the lid to pivot relative to the base.

20. A device for storing and transporting a substance, the device comprising:

a base having a compartment for containing the substance;

a lid closing the compartment of the base, the lid being coupled to the base so as to selectively open and close the compartment of the base to selectively permit access to the compartment within the base;

at least one cavity defined by the lid, the base, or at least in part a combination thereof, the cavity defining at least a first opening at an exterior of the device; and an unlocking mechanism that immobilizes the lid relative to the base when the compartment of the base is closed by the lid and releases the lid to enable the lid to pivot relative to the base to open the compartment of the base, the unlocking mechanism being recessed within the cavity a recessed distance from the first opening of the cavity that is sufficient so as to be accessible through the first opening with a finger of an adult but inaccessible by a finger of a child;

wherein the cavity is defined by a tubular portion comprising first and second halves connected to each other by a hinge, the first half is integrally formed with the lid, and the second half is integrally formed with the base.

* * * * *